United States Patent [19]

Tsuda et al.

[11] 4,269,407

[45] May 26, 1981

[54] SHEET HOLDING CASSETTE

[75] Inventors: Hiroshi Tsuda, Mitaka; Kiyoshi Miyashita; Takashi Matsuyama, both of Hachioji, all of Japan

[73] Assignee: Olympus Optical Co., Ltd., Tokyo, Japan

[21] Appl. No.: 55,297

[22] Filed: Jul. 5, 1979

[30] Foreign Application Priority Data

Jul. 19, 1978 [JP] Japan ..... 53-87045
Jan. 26, 1979 [JP] Japan ..... 54-7804

[51] Int. Cl.[3] ..... B65H 1/24
[52] U.S. Cl. ..... 271/127; 271/160; 271/170
[58] Field of Search ..... 271/127, 160, 170, 171, 271/164

[56] References Cited

U.S. PATENT DOCUMENTS

| | | | |
|---|---|---|---|
| 3,635,468 | 1/1972 | Suzuki et al. | 271/127 |
| 3,919,972 | 11/1975 | Komori et al. | 271/127 |
| 3,933,349 | 1/1976 | Limberger et al. | 271/127 |
| 3,977,666 | 8/1976 | Suzuki et al. | 271/160 |
| 4,060,233 | 11/1977 | Stange et al. | 271/160 |
| 4,106,763 | 8/1978 | Tani et al. | 271/160 |

*Primary Examiner*—Bruce H. Stoner, Jr.
*Assistant Examiner*—Brian Bond
*Attorney, Agent, or Firm*—Haseltine and Lake

[57] ABSTRACT

A sheet holding cassette comprising a box-shaped main body open at its base and closed by a sheet receiving plate pivoted to the main body, means for releasably locking the sheet receiving plate, and means for resiliently locating the uppermost sheet of a stack of sheets charged into the main body at a given position irrespective of change of the number of the sheets.

6 Claims, 22 Drawing Figures

SHEET HOLDING CASSETTE

BACKGROUND OF THE INVENTION

1. Field of the Invention

This invention relates to a sheet holding cassette which is applicable to electrographic apparatuses, printing machines or the like and can supply sheets such as record sheets one by one from a stack of sheets enclosed in the cassette and composed of a number of superimposed sheets.

2. Description of the Prior Art

In an electrographic apparatus, printing machine or the like, if a number of sheets such as record sheets or the like are set beforehand, a sheet supplying device for supplying these sheets one by one has frequently been used. Such sheet supplying device has been classified into the following two devices. That is, a device for directly charging the sheets into a main body thereof and a second device which makes use of a cassette enclosing a stack of sheets therein and detachably mounted on the main body thereof. The second device has the advantage that it is particularly simple in operation.

A cassette for such sheet supplying device is composed of a rectangular box-shaped main body open at its top and provided at its upper front end corners with separating claws, respectively, and at its base with a sheet receiving plate loosely engaged with the main body. The sheet receiving plate is permitted to freely move up and down in the cassette. In addition, a base plate of the cassette is provided with openings through which is extended a projecting rod for moving the sheet receiving plate from the outside of the cassette.

When the cassette is mounted on the sheet supplying device, the main body is supported by a supporting member and the sheet receiving plate is supported by the projecting rod extending through the opening provided in the base plate. As a result, the sheets enclosed in the cassette are sandwiched between the separating claws and the sheet receiving plate. This condition is not changed even when the number of sheets, that is, the thickness of the stack of sheets becomes changed. The use of a sheet picking up roller ensures a positive supply of the sheets one by one. When the cassette is mounted on such sheet supplying device, the opening provided in the base of the cassette must be extended through the projecting rod. As a result, it is very difficult to charge the stack of sheets into the sheet supplying device. In addition, as the number of sheets is decreased, the position of the separating claws becomes lowered down, so that the sheet supplying position is changed, thereby changing the sheet transfer path. As a result, it is impossible to charge a large number of sheets into the sheet supplying device.

In another conventional sheet supplying device, the cassette mounted on the device is made stationary, while the projecting rod extending through the opening provided in the cassette base is made movable so as to upwardly urge the uppermost sheet of the stack of sheets against the sheet supply roller. In such conventional device, the position of the uppermost sheet of the stack of sheets is not changed irrespective of the change of the number of sheets. As a result, it is possible to eliminate the above mentioned disadvantage of the former device. But, when the cassette is removed from the device, the cassette must be disengaged from the projecting rod. In addition, the projecting rod must be constructed so as to be urged against the sheet receiving plate. As a result, such conventional device is also troublesome in operation and complex in construction.

In the above mentioned conventional devices, the sheet must be inserted beneath the separating claws when the stack of sheets is charged into the cassette, thereby rendering the charging operation of the stack of sheets into the cassette troublesome.

SUMMARY OF THE INVENTION

An object of the invention, therefore, is to provide a sheet holding cassette which can easily be inserted into and removed from the sheet supplying device and into which a stack of sheets can easily be charged.

Another object of the invention is to provide a sheet holding cassette which can also be used as a sheet delivery tray.

A feature of the invention is the provision of a sheet holding cassette comprising a box-shaped main body adapted to enclose therein a stack of sheets composed of a number of superimposed sheets and locally provided in its upper surface with a window through which means for picking up and feeding the sheets one by one is urged against the uppermost sheet of said stack of sheets, said main body being open at its base, a sheet receiving plate having a dimension which is sufficient to close substantially all of the open base of said main body and pivoted to said main body so as to be rotated toward both the inside and the outside of said main body, means for releasably locking said sheet receiving plate and preventing it from rotating toward the outside of said main body, a separating claw arranged near said window and operative to separate said uppermost sheet one by one from said stack of sheets, said main body being turned upside down and said sheet receiving plate being rotated toward the outside of said main body in the case of charging said stack of sheets into the main body, and means for resiliently locating said uppermost sheet of said stack of sheets at a given position irrespective of change of the number of said sheets when said main body with its open base closed is inserted into said sheet supplying device.

Further objects and features of the invention will be fully understood from the following detailed description with reference to the accompanying drawings, in which:

DETAILED DESCRIPTION OF THE PREFERRED EMBODIMENTS

Figure 1A:
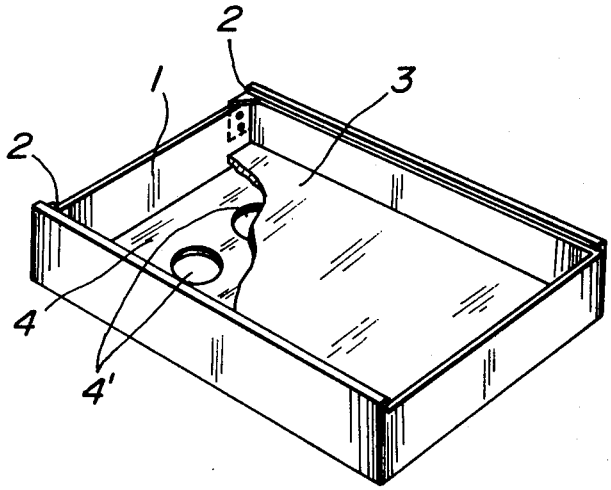
FIG. 1a PRIOR ART
FIG. 1*a* is a perspective view of a conventional sheet holding cassette.
Figure 1B:
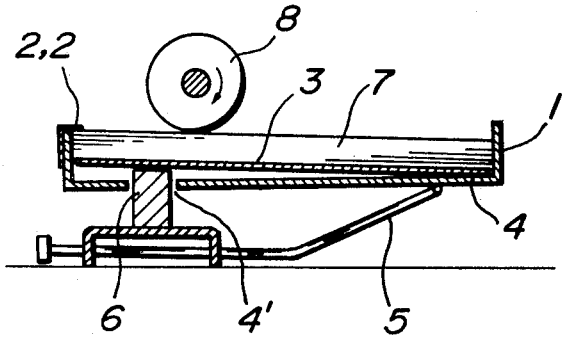
FIG. 1b PRIOR ART
FIG. 1*b* is a longitudinal sectional view of the cassette shown in FIG. 1*a* and mounted on a conventional sheet supplying device.

FIG. 1*a* shows a conventional sheet holding cassette and FIG. 1*b* shows the cassette shown in FIG. 1*a* and mounted on a conventional sheet supply device. Referring to FIGS. 1*a* and 1*b*, reference numeral 1 designates a rectangular box-shaped cassette main body open at its top and provided at its upper front end corners with separating claws 2, 2, respectively, and at its base with a sheet receiving plate 3 loosely enclosed in the main body 1. The sheet receiving plate 3 is made movable up and down. In addition, a base plate 4 of the main body 1 is provided with openings 4' through which are extended projecting rods 6 (only one is shown) so as to move the sheet receiving plate 3 from the outside of the main body 1.

When the cassette is mounted on the sheet supplying device, the main body 1 is supported by a supporting member 5 and the sheet receiving plate 3 is supported by projecting rods 6, 6 extending through the openings 4' provided in the base plate 4. As a result, a stack of sheets 7 enclosed in the main body 1 is sandwiched between the separating claws 2, 2 and the sheet receiving plate 3. This condition is not changed even when the number of sheets, that is, the thickness of the stack of sheets 7 becomes changed.

If a sheet picking up roller 8 is urged against the uppermost sheet of the stack of sheets 7 and rotated in a clockwise direction as shown by an arrow in FIG. 1*b*, it is possible to pick up the sheets one by one from the stack of sheets 7 through the separating claws 2, 2.

When the cassette is mounted on the sheet supplying device, the openings 4' provided in the base plate 4 must be extended through by the projecting rods 6, respectively. As a result, it is very difficult to charge the cassette into the sheet supplying device. In addition, as the number of sheets is decreased, the position of the separating claws 2, 2 secured to the main body 1 becomes lowered down, so that the sheet supplying position is changed, thereby changing the sheet transfer path. As a result, it is impossible to charge a stack of a large number of sheets into the cassette.

In another conventional sheet supplying device, the cassette 1 mounted on the device is made stationary, while the projecting rods 6, 6 extending through the openings 4' provided in the base plate 4 are made movable so as to upwardly urge the uppermost sheet of the stack of sheets 7 against the sheet supply roller 8.

In such conventional device, the position of the uppermost sheet is not changed irrespective of the change of the number of sheets. As a result, it is possible to eliminate the above mentioned disadvantage of the former conventional device. But, when the cassette is to be removed from the device, the cassette must be disengaged from the movable projecting rods 6, 6. In addition, the projecting rods 6, 6 must be constructed so as to be always urged against the sheet receiving plate 3. As a result, such conventional device is also troublesome in operation and complex in construction.

In the above mentioned two conventional devices, when the stack of sheets 7 is charged into the cassette 1, the stack of sheets 7 must be inserted into and engaged with the lower surface of the separating claws 2, 2, thereby rendering the charging operations of the stack of sheets into the cassette troublesome.

Figure 2:
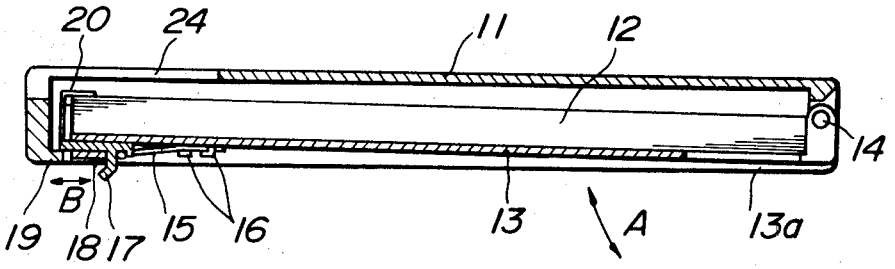
FIG. 2 is a longitudinal sectional view of one embodiment of a sheet holding cassette according to the invention.
Figure 3:
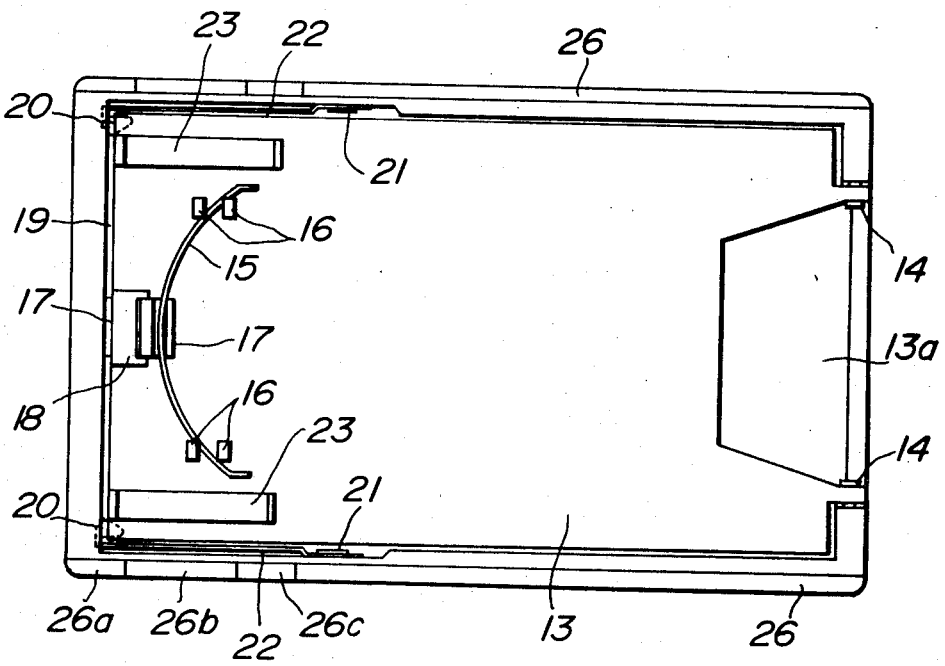
FIG. 3 is its rear view.
Figure 4:
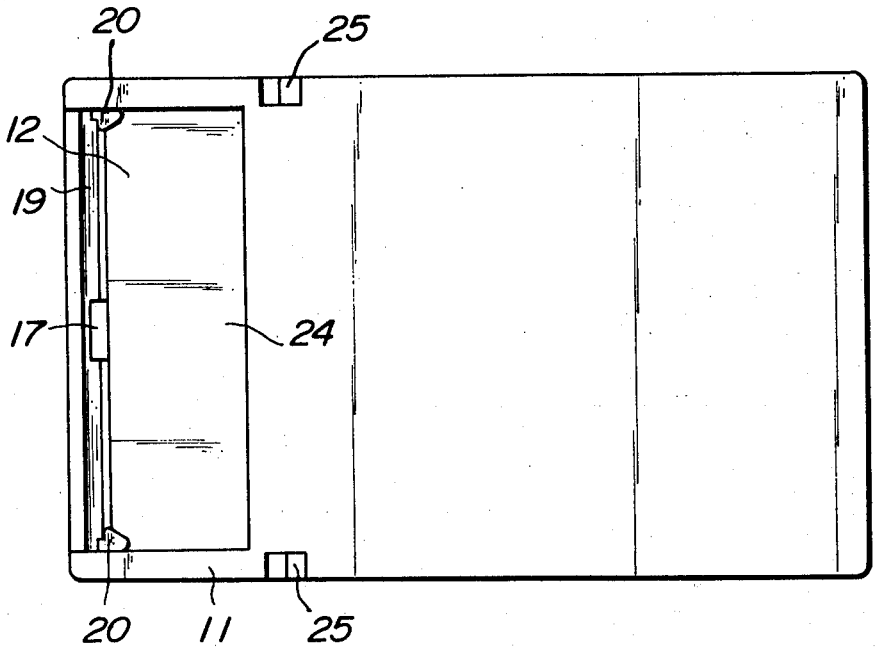
FIG. 4 is its plan view.

FIGS. 2 to 4 show one embodiment of a sheet holding cassette according to the invention. FIG. 2 is a section taken on a direction along which a sheet is supplied. FIG. 3 is its rear view and FIG. 4 is its plan view. One end of a sheet receiving plate 13 is pivoted to a shaft 14 such that the sheet receiving plate 13 is rotatable about the shaft 14 in two directions shown by arrows A in FIG. 2. The sheet receiving plate 13 is provided at its free end with a spring 15, spring holders 16 and a stopper 17. The stopper 17 is supported by a holding member 18 and adapted to be slidably moved in directions shown by arrows B in FIG. 2. The stopper 17 is normally pushed leftwardly by means of the spring 15, so that if the sheet receiving plate 13 is brought into its closed position, the stopper 17 becomes engaged with the upper surface of a lower end edge 19 of the main body 11. As a result, it is impossible to open the sheet receiving plate 13 unless the stopper 17 is manually moved toward the right against the action of the spring 15.

Figure 5:
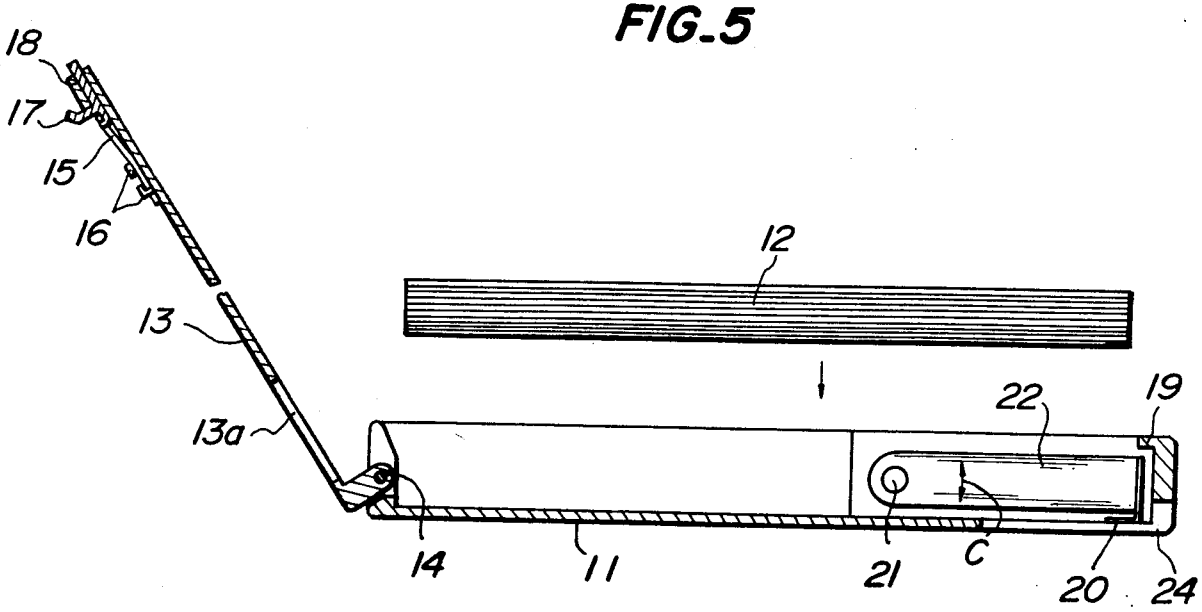
FIG. 5 is a longitudinal sectional view of the cassette shown in FIG. 2 under a condition that the cassette is turned upside down and its sheet receiving plate is opened toward the outside of the main body.

As shown in FIG. 3, arms 22 are pivoted to shafts 21, respectively, and made rotatable about the shafts 21 in directions shown by arrows C in FIG. 5. To the free ends of the arms 22 are secured separating claws 20 adapted to separate and deliver the uppermost sheet from the stack of sheets 12. The separating claws 20, 20 per se are the same as the separating claws 2, 2 shown in FIGS. 1*a* and 1*b*, so that the function thereof will not be described in detail.

In the present invention, the separating claw 20 is rotatable about the shaft 21 and adapted to be brought into contact with the corners of the uppermost sheet of the stack of sheets 12 as shown in FIG. 2.

Figure 9:
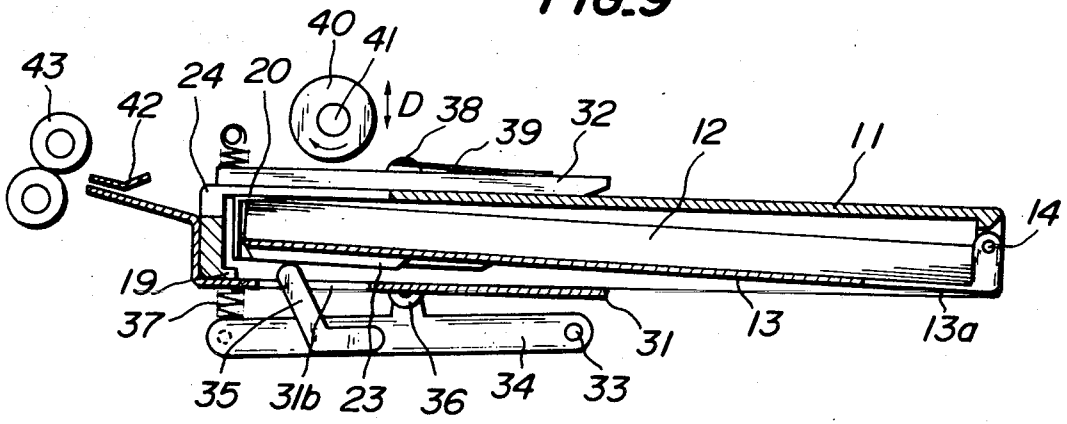
FIG. 9 is a longitudinal sectional view of the cassette under the condition shown in FIG. 8.

In addition, the sheet receiving plate 13 is provided at the lower surface of the free end thereof with two trapezoidal legs 23, 23 adapted to be engaged with a pushing up member 35 as shown in FIG. 9. The sheet receiving plate 13 is provided at the side of the shaft 14 thereof with an opening 13*a* as shown in FIGS. 3 and 5. The opening 13*a* is adapted to receive a user's hand when the user holds both ends of the stack of sheets 12 and charge it into the cassette 11 as shown in FIG. 5. As shown in FIG. 2, the cassette 11 is provided at its upper surface with a window 24 through which a sheet feed roller 40 is urged against the uppermost sheet of the stack of sheets 12.

Figure 8:
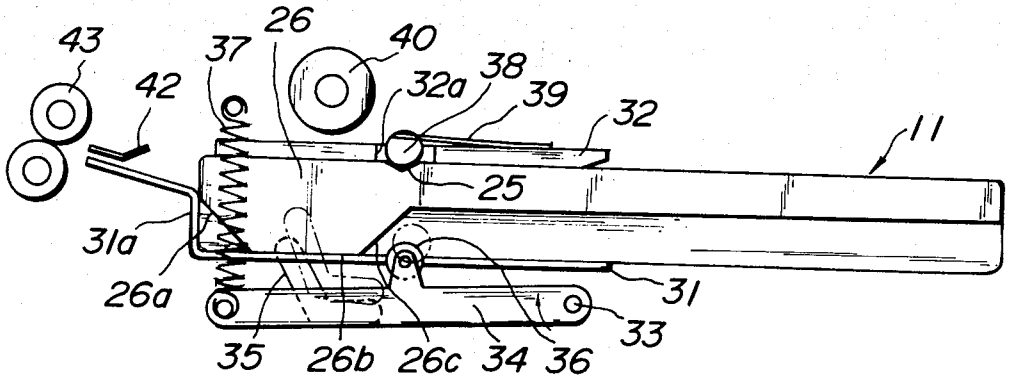
FIG. 8 is a front elevational view of the cassette shown in FIG. 2 under a condition that the cassette is completely inserted into the sheet supplying device shown in FIG. 6.

Referring to FIG. 4, reference numeral 25 designates a click depression adapted to receive a ball 38 as shown in FIG. 8 and maintain the cassette 11 at its position shown in FIG. 8. In addition, the cassette 11 is provided at its both side surfaces with a guide member 26 adapted to guide the pushing up member 35 of the sheet supplying device when the cassette is inserted into the sheet supplying device. The operation of the guide member 26 will be described in greater detail.

Figure 6:
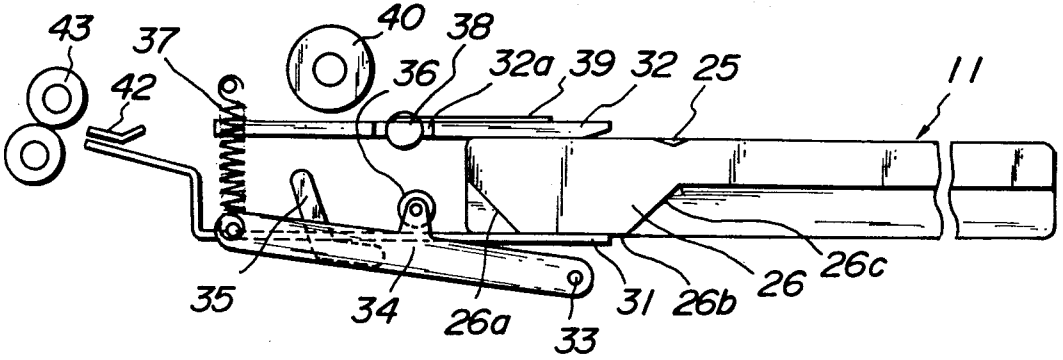
FIG. 6 is a front elevational view of the cassette shown in FIG. 2 under a condition that the cassette is partly inserted into a sheet supplying device provided with one embodiment of a resilient member for urging a stack of sheets against separating claws according to the invention.

FIG. 6 shows a condition under which the cassette 11 is partly inserted into the sheet supplying device. The cassette 1 is slidably inserted between a cassette receiving plate 31 for supporting the lower surface of the cassette 11 and a side guide 32 for guiding the upper and side surfaces of the cassette 11. The sheet supplying device is provided at those positions of the cassette 11 which correspond to substantially both side edges thereof with arms 34 pivoted to shafts 33, respectively, each shaft 33 being rotatably journaled in the device.

Each of the arms 34 is provided near its free end with a pushing up member 35 adapted to be urged against the trapezoidal legs 23, 23 provided on the lower surface of the sheet receiving plate 13 and at substantially center thereof with a roller 36 adapted to be engaged with the above mentioned guide 26 so as to control the movement of the arm 34 when the cassette is inserted into the sheet supplying device. The pushing up member 35 is composed of an L-shaped lever having one arm secured to the rotary lever 34. The free end of the lever 34 and hence another arm of the lever 35 is normally pulled upwardly by means of a spring 37. The side guide 32 is provided at that part thereof which is engaged with the upper surface of the cassette 11 with an opening 32*a* through which is projected a ball 38 secured to the free end of a leaf spring 39 and adapted to be moved upwardly and downwardly.

Figure 7:
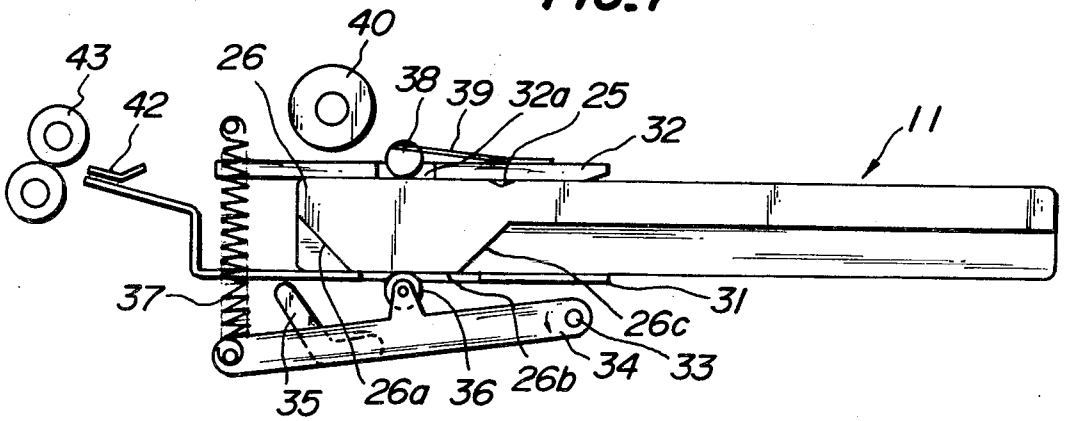
FIG. 7 is a front elevational view of the cassette shown in FIG. 2 under a condition that the cassette is further inserted into the sheet supplying device shown in FIG. 6.

FIG. 7 shows a condition under which the cassette 11 is further inserted into the sheet supplying device. In this condition, the roller 36 is moved downwardly along an inclined surface 26*a* of the guide member 26 so as to considerably rotate the arm 34 downwardly. As a result, the pushing up member 35 is also moved downwardly to a position where the pushing up member 35 does not prevent a further insertion of the cassette 11. In addition, the click ball 38 is pushed up by means of the cassette 11.

FIG. 8 shows a condition under which the cassette 11 has completely been inserted into the sheet supplying device. In this condition, the front end of the cassette 11 becomes engaged with a rising up portion 31*a* of the cassette receiving plate 31 to stop the insertion of the cassette 11 and the click ball 38 becomes engaged with the click depressions 25 provided in both sides of the upper surface of the cassette 11 as shown in FIG. 4 so as to determine the position of the cassette which has completely been inserted into the sheet supplying device. The rollers 36 become disengaged from the salient portions 26*b*, 26*b*, so that the arms 34 and hence the pushing up members 35, 35 are pulled up by means of the springs 37. The pushing up members 35, 35 are urged against the legs 23, 23 of the sheet receiving plate 13, thereby pushing up the sheet receiving plate 13.

FIG. 9 shows the condition shown in FIG. 8 in section. The pushing up members 35 are extended through an opening 31*b* provided in the cassette receiving plate 31 and urged against the leg portions 23, 23 of the sheet receiving plate 13. As a result, the front end of the stack of sheets 12 is urged against the separating claws 20. The separating claws 20 are also rotated upwardly and become engaged with and stopped by the cassette 11.

The sheet supplying device is provided with a sheet pick up roller 40 rotatably mounted on a shaft 41 and adapted to be moved in directions shown by arrows D in FIG. 9.

If the sheet pick up roller 40 is lowered down and brought into contact with the uppermost sheet of the stack of sheets 12, the pick up roller 40 causes the uppermost sheet to be separated from the remainder of the stack of sheets with the aid of the separating claws 20, 20 and to be fed to the outside of the cassette 11 through the window 24. The sheet taken out of the cassette 11 is fed through a guide 42 to rollers 43 which serve to deliver the sheet to the next stage. Similarly, the successive sheets are delivered from the stack of sheets 12 one by one. Even if the thickness of the stack of sheets 12 is decreased, the pushing up member 35 serves to always urge the sheet receiving plate 13 upwardly against the picking up roller 40. As a result, the uppermost sheet of the stack of sheets 12 is always urged against the separating claws 20, 20 and the picking up roller 40 functions together with the separating claws 20, 20 to separate the uppermost sheet of the stack of sheets 12 from the remaining sheets.

Figure 10:
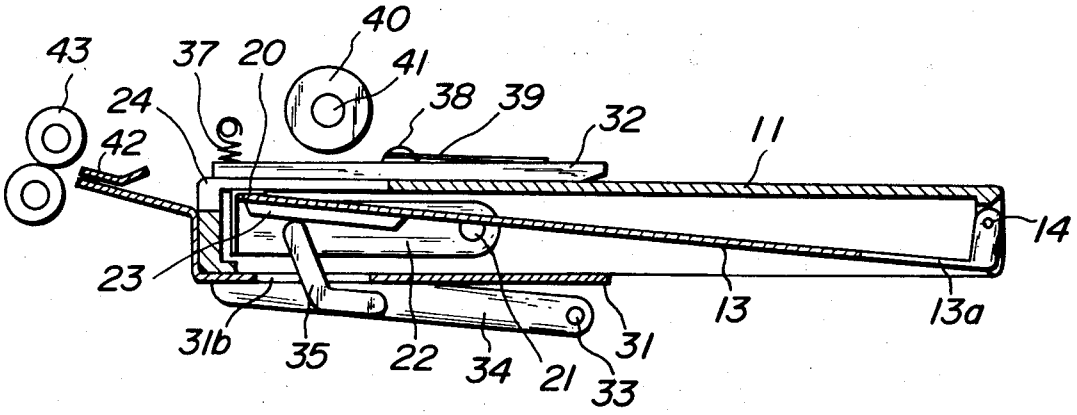
FIG. 10 is a longitudinal sectional view of the cassette shown in FIG. 2 under a condition that its sheet receiving plate has no sheet charged thereon.

FIG. 10 shows a condition under which all of sheets of the stack of sheets 12 have been removed from the sheet receiving plate 13.

The operation of pulling out the cassette 11 from the sheet supplying device will now be described.

This operation is effected in the order which is opposite to the order as mentioned with reference to FIGS. 6 to 8. That is, in the first place, the cassette 11 is pulled out from the condition shown in FIG. 8. Then, the click balls 38, 38 become disengaged from the click depressions 25, 25, respectively. Then, the roller 36 is brought into engagement with the inclined surface 26*c* and then pushed down along the inclined surface 26*c*, so that the arm 34 causes the pushing up members 35 to move downwardly.

FIG. 7 shows this condition.

As a result, the pushing up member 35 is separated from the sheet receiving plate 13 located at the lower surface of the cassette, thereby permitting a further withdrawal of the cassette.

FIG. 6 shows a condition under which the cassette 11 has been substantially withdrawn.

In the case of charging the stack of sheets 12 into the cassette 11, the cassette 11 is turned upside down and then the stopper 17 is manually disengaged from the end edge 19 of the cassette 11 so as to open the sheet receiving plate 13 as shown in FIG. 5. Under this condition, it is possible to charge the stack of sheet 12 into the cassette as shown by an arrow in FIG. 5. In this case, the inner end edge 19 of the cassette 11 is aligned with vertical portions of L-shaped separating claws 20, 20 or or slightly projected inwardly from the vertical portions of the separating claws 20, 20 such that the stack of sheets 12 can freely be disposed on horizontal portions of the claws 20, 20. After the stack of sheets 12 has been charged into the cassette 11, the sheet receiving plate 13 is closed, thereby completing the charge of the stack of sheets 12 into the cassette 11. Then, the cassette 11 is turned upside down and brought into the condition shown in FIG. 2. If the inner width of the cassette 11 is made substantially equal to the width of the stack of sheets 12, there is no risk of the stack of sheets 12 charged in the cassette being displaced.

In the above embodiment, the resilient member composed of the pivotally mounted arms 34, pushing up member 35 and spring 7 and urging the stack of sheets 12 against the separating claws 20, 20 is provided on the sheet supplying device. In the following embodiments, such resilient member is provided on the cassette.

Figure 11:
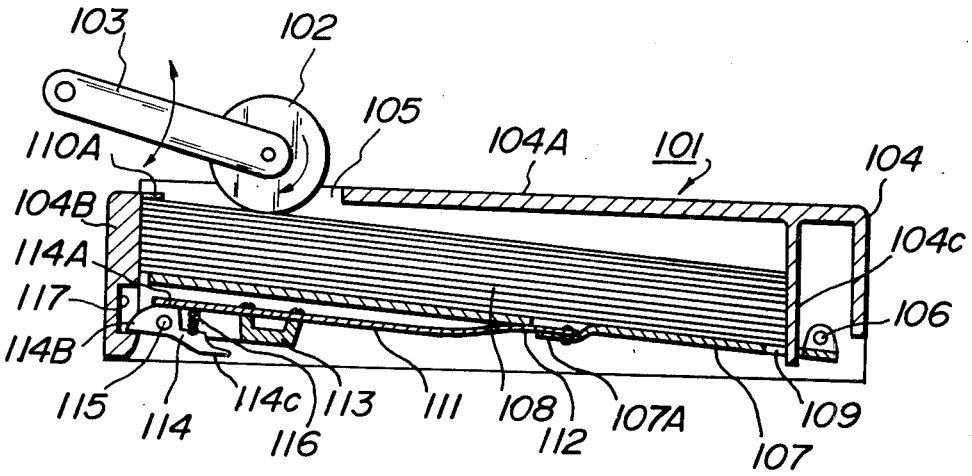
FIG. 11 is a longitudinal sectional view of another embodiment of a sheet holding cassette according to the invention.
Figure 12:
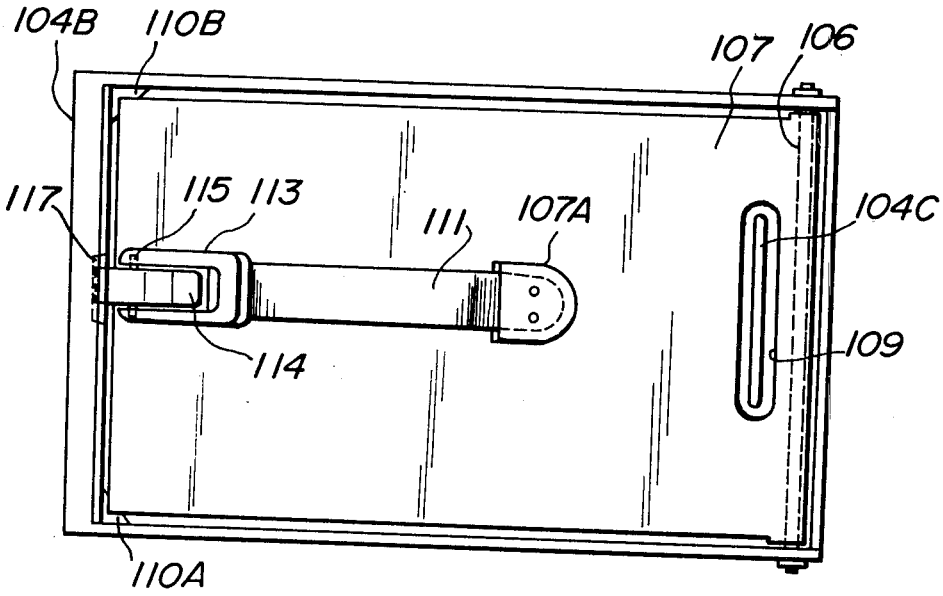
FIG. 12 is its rear view.
Figure 13:
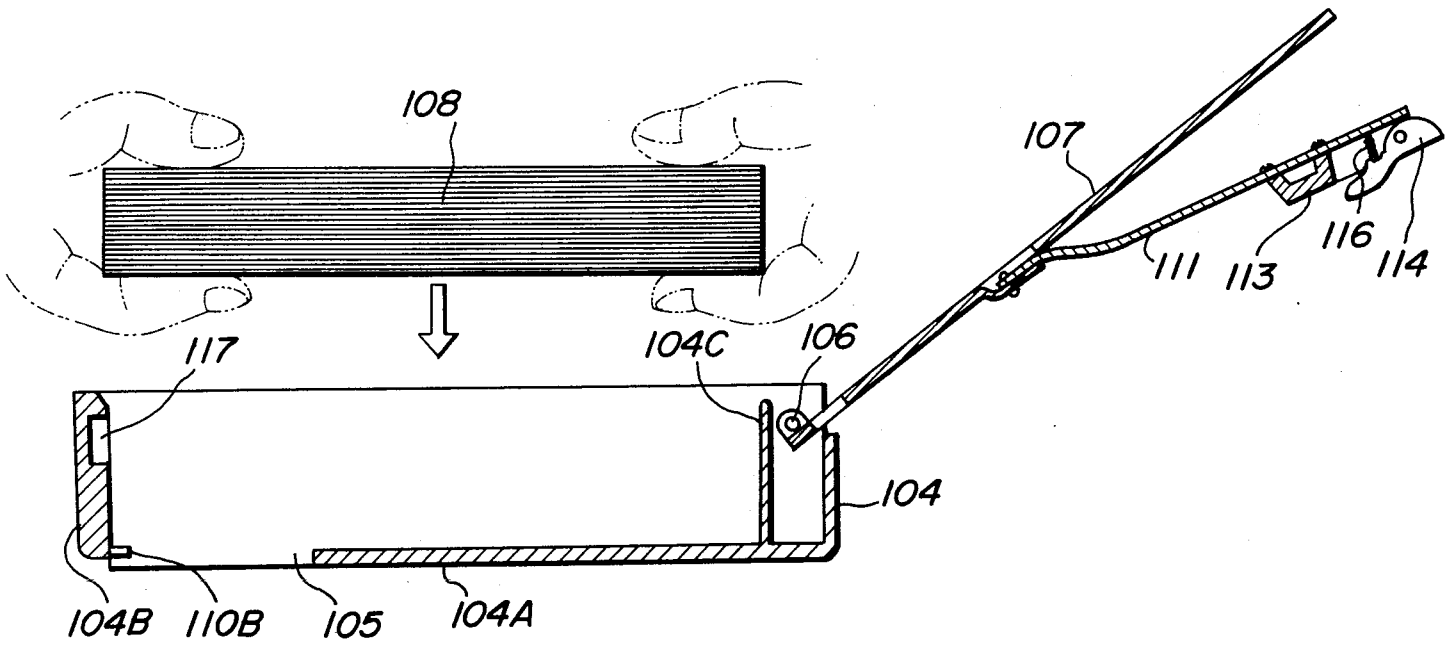
FIG. 13 is a longitudinal sectional view of the cassette shown in FIG. 11 under a condition that the cassette is turned upside down and its sheet receiving plate is opened toward the outside of the main body.

FIGS. 11 to 13 show another embodiment of a sheet holding cassette according to the invention. FIG. 11 shows a sheet holding cassette 101 mounted on a sheet supplying device according to the invention. The sheet supplying device is provided with a sheet feed roller 102 adapted to be rotated in a clockwise direction shown by an arrow and supported by a rocking arm 103. The roller 102 is brought into contact with a stack of sheets 108 and separated therefrom. The cassette 101 is composed of a main body 104 formed of plastics, for example, and made integral into one body by molding. The cassette main body 104 is of substantially box-shaped and provided in its upper surface 104A with a window 105 through which the sheet feed roller 102 is urged against the uppermost sheet of the stack of sheets 108 and separated therefrom. The cassette main body 104 is open at its base. This open base of the cassette main body 104 is substantially closed by a sheet receiving plate 107 having one end rotatably mounted on a shaft 106. On the sheet receiving plate 107 is disposed the stack of sheets 108 whose position is determined by the side wall of the cassette main body 104, front wall 104B and end stopper 104C.

As clearly shown in FIG. 12, the sheet receiving plate 107 is provided near the pivoted end thereof with an opening 109 through which is extended the end stopper 104C. The cassette main body 104 is provided at the upper end of the front wall thereof with separating claws 110A, 110B for the purpose of separating the uppermost sheet from the stack of sheets 108 charged into the cassette main body 104 one by one and feeding it to transfer rolls. In the present embodiment, these separating claws 110A, 110B are fixed to the front wall 104B of the cassette main body 104.

FIG. 13 shows the cassette 101 taken out of the sheet supplying device and turned upside down for the purpose of charging the stack of sheets 108 into the cassette 104. As clearly shown in FIGS. 11 and 12, provision is made of a leaf spring 111 having one end secured to substantially center of the outer surface of the sheet receiving plate 107 by riveting, for example. That is, a portion 107A of the sheet receiving plate 107 is projected outwardly to form a projection to which is secured one end of the leaf spring 111. In this case, the leaf spring 111 is urged against the sheet receiving plate 107 at a position 112. The leaf spring 111 is extended forwardly along the outer surface of the sheet receiving plate 107 and provided at its front end portion with a handle 113. The handle 113 is provided with a depression in which is rotatably mounted a hook 114 about a shaft 115.

As shown in FIG. 11, between the hook 114 and the leaf spring 111 is inserted a compression spring 116 that tends to rotate the hook 114 in a clockwise direction in the plane shown in FIG. 11. This rotation of the hook 114 is stopped when the base 114A of the hook 114 becomes engaged with the leaf spring 111. In addition, the front end 114B of the hook 114 is projected into a depression 117 and brought into engagement with the side wall of the depression 117.

In the condition shown in FIGS. 11 and 12, the hook 114 engages with the depression 117 of the cassette main body 104 and the sheet receiving plate 107 is urged inwardly toward the cassette main body 104 and hence urging the stack of sheets 108 against the separating claws 110A, 110B. As the number of sheets in the cassette is reduced, the sheet receiving plate 107 is rotated inwardly until the last sheet is urged against the separating claws 110A, 110B.

FIG. 13 shows the cassette main body 104 turned upside down and the sheet receiving plate 107 opened upwardly from the open upper surface of the cassette main body 104. In order to open the sheet receiving plate 107, the rear end 114C of the hook 114 is pushed inwardly into the cassette main body 104 so as to get away the front end 114B of the hook 114 from the depression 117 formed in the front wall 104B of the cassette main body 104.

After the stack of sheets 108 has been charged into the cassette main body 104, the sheet receiving plate 107 is located so as to close the open part of the cassette main body 104 and then the handle 113 is pushed downwardly to cause the front end 114B of the hook 114 to bring into engagement with the depression 117.

In the present embodiment, if the stack of sheets 108 is charged into the cassette main body 104 and then the open base of the cassette main body 104 is closed by the sheet receiving plate 107, it is possible to urge the stack of sheets 108 against the separating claws 110A, 110B.

As a result, the sheet supplying device is not required to provide a mechanism for inwardly urging the sheet receiving plate into the cassette main body. Thus, the sheet supplying device becomes simple in construction. In addition, the handle 113 secured to the leaf spring 111 functions as a handle for opening and closing the sheet receiving plate 107, so that it is possible to eliminate a separate handle. As shown in FIG. 12, the handle 113 is constructed such that it covers the sharp edge of the leaf spring 111, so that there is no risk of the user being injured by the sharp edge of the leaf spring 111. In addition, it is possible to improve the rigidity of the sharp edge of the leaf spring 111 and make the resilient urging force subjected to the sheet receiving plate 107 large.

Figure 15:
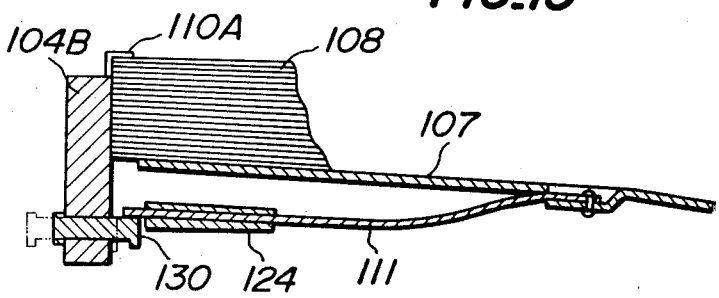
FIG. 15 is a partial longitudinal sectional view of a still further embodiment of a sheet holding cassette according to the invention.
Figure 16A:
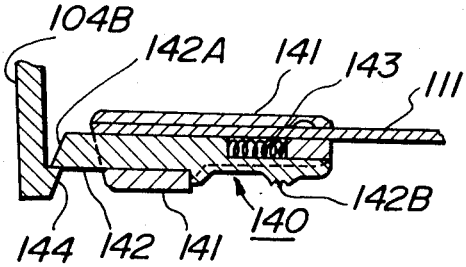
FIG. 16*a* is a partial longitudinal sectional view of another embodiment of a sheet holding cassette according to the invention.
Figure 16B:
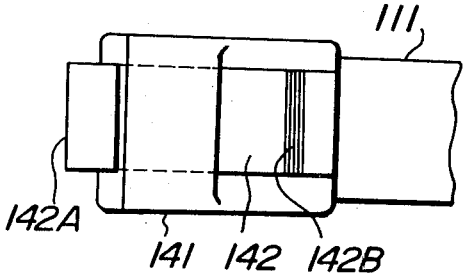
FIG. 16*b* is its plan view.
Figure 16C:
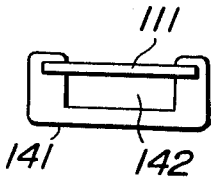
FIG. 16*c* is its end view.
Figure 17:
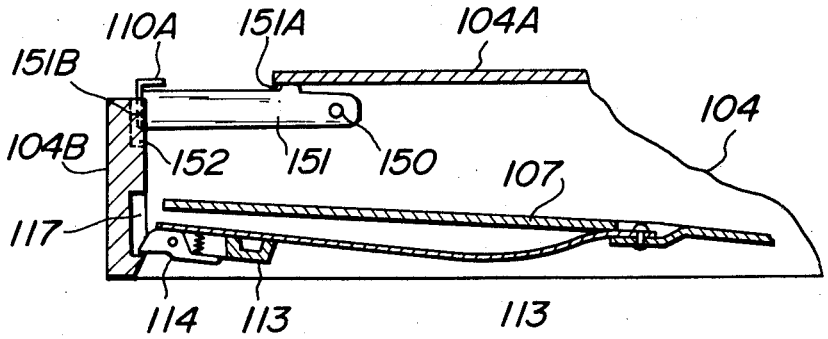
FIG. 17 is a longitudinal sectional view of another embodiment of a sheet holding cassette according to the invention.

FIGS. 15 to 17 show further embodiments of a sheet holding cassette according to the invention. In these embodiments, the releasably locking mechanisms for the sheet receiving plate only are different from that of the previous embodiment shown in FIGS. 11 to 13, so that the same parts are designated by the same reference numerals.

Figure 14:
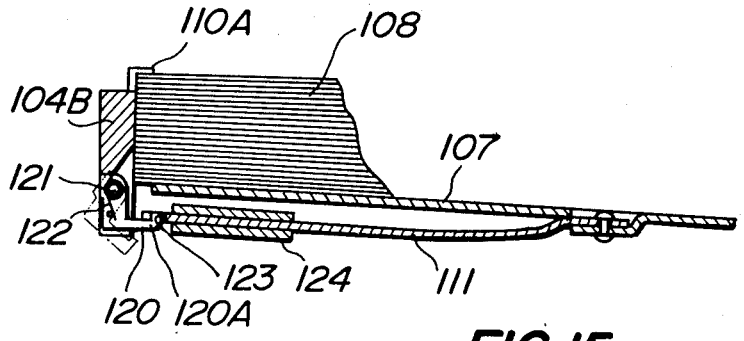
FIG. 14 is a partial longitudinal sectional view of a further embodiment of a sheet holding cassette according to the invention.

In the embodiment shown in FIG. 14, a hook 120 is rotatably mounted on a shaft 121 secured to the front wall 104B of the cassette main body. Around the shaft 121 is wound a coil spring 122 for causing the hook 121 to rotate in a clockwise direction. A leaf spring 111 is provided at its front end with a hole 123 adapted to receive the front end 120A of the hook 120 and a pad 124 extended through by the leaf spring 111.

In the condition shown in FIG. 14, the leaf spring 111 engages with the cassette main body. The resilient force of the leaf spring 111 functions to urge the stack of sheet 108 against the separating claws 110A.

If the pad 124 is slightly pushed inwardly toward the cassette main body against the action of the resilient force of the leaf spring 111, it is possible to disengage the leaf spring 111 from the hook 120. If the pad 124 is slightly pushed inwardly toward the cassette main body, the front end 120A of the hook 120 becomes disengaged from the hole 123 provided in the leaf spring 111. Then, the coil spring 122 causes the hook 120 to rotate in the clockwise direction to a position shown by dot-dash lines, thereby disengaging the leaf spring 111 from the cassette main body.

FIG. 15 shows a still further embodiment of a sheet holding cassette according to the invention. In the present embodiment, provision is made of a hook 130 slidably extending through the front wall 104B of the cassette main body and having an inner end adapted to be engaged with the front end of a leaf spring 111. If the hook 130 is pulled forwardly, it is possible to open the leaf spring 111 and hence the sheet receiving plate 107.

FIGS. 16*a*, 16*b* and 16*c* show another embodiment of a sheet holding cassette according to the invention. In the present embodiment, a leaf spring 111 is provided at its front end with a hook 140. The hook 140 is composed of a fixed portion 141 secured to the leaf spring 111 and a slidable portion 142 slidably arranged along the plane of the leaf spring 111. Between the fixed portion 141 and the slidable portion 142 is arranged a compression coil spring 143 for causing the slidable portion 142 to move toward the left.

If a sheet receiving plate (not shown) is closed, the front end portion 142A of the slidable portion 142 engages with the projection 144 formed in the front wall 104B of the cassette main body. If the user moves his finger put on the rear end 142B toward the right as viewed in FIG. 16A so as to backwardly move the front end 142A from the projection 144, it is possible to disengage the front end 142A of the slidable portion 142 from the projection 144 and hence open the sheet receiving plate. In the case of closing the sheet receiving plate, the tapered front end 142A of the slidable portion 142 becomes engaged with the tapered projection 144 which causes the slidable portion 142 to automatically move toward the right as viewed in FIG. 17A. As shown in FIG. 16C, since the leaf spring 111 is enclosed within the fixed portion 141 of the hook 140, it is possible to protect the user from being cut by the sharp edge of the leaf spring 111 and increase the rigidity of that part of the leaf spring 111 which is enclosed by the fixed portion 141.

FIG. 17 shows another embodiment of a sheet holding cassette according to the invention. In the present embodiment, use is made of a sheet receiving plate 107, leaf spring 111 and hook 114 which are the same as those shown in FIGS. 11 to 13, but a separating claw 110A is not fixed. That is, in the present embodiment, the separating claw 110A is secured to the front end of an arm 151 rotatably mounted on a shaft 150. The rotation of the arm 151 is limited when a projection 151A formed on the arm 151 engages with the upper surface 104A of the cassette main body 104 and when the front end 151B of the arm 151 engages with the base of a depression 152 formed in the front wall 104B of the cassette main body 104. As a result, the arm 151 and hence the separating claw 110A can freely move within the above mentioned limited range.

Figure 18:
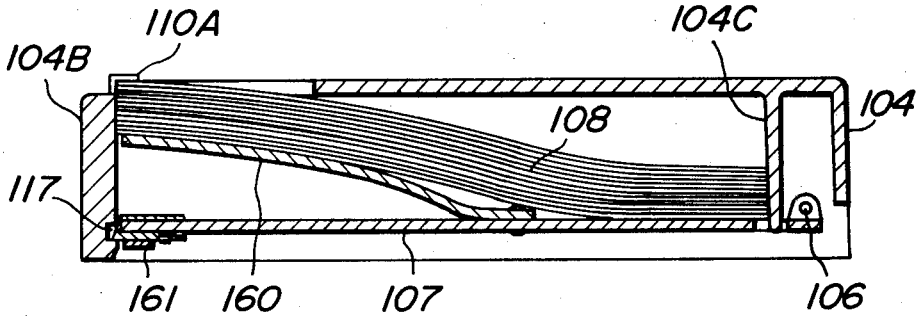
FIG. 18 is a longitudinal sectional view of another embodiment of a sheet holding cassette according to the invention.

FIG. 18 shows another embodiment of a sheet holding cassette according to the invention. In the present embodiment, a sheet receiving plate 107 is rotatably mounted on a shaft 106 in the same manner as the previous embodiments. In the present embodiment, one end of a leaf spring 160 is secured to substantially the center of the inner surface of the sheet receiving plate 107 and the width of the leaf spring 160 is made wider than that of the leaf spring 111 shown in FIGS. 12, 16*b* and 16*c*, that is, is made substantially the same as that of the cassette main body 104. In order to engage the free end of the sheet receiving plate 107 with the cassette main body 104, a hook 161 is secured to the free end of the sheet receiving plate 107 and the front end of the hook 161 is adapted to be engaged with a depression 117 formed in the front wall 104B of the cassette main body 104. The construction of the hook 161 is the same as that shown in FIGS. 16A and 17B.

In the present embodiment, if the sheet receiving plate 107 is closed, it is possible to urge a stack of sheet 108 charged in the cassette main body 104 against the separating claw 110A by the resilient force of the leaf spring 160.

The cassette according to the invention may also be used as a delivery tray.

Figure 19:
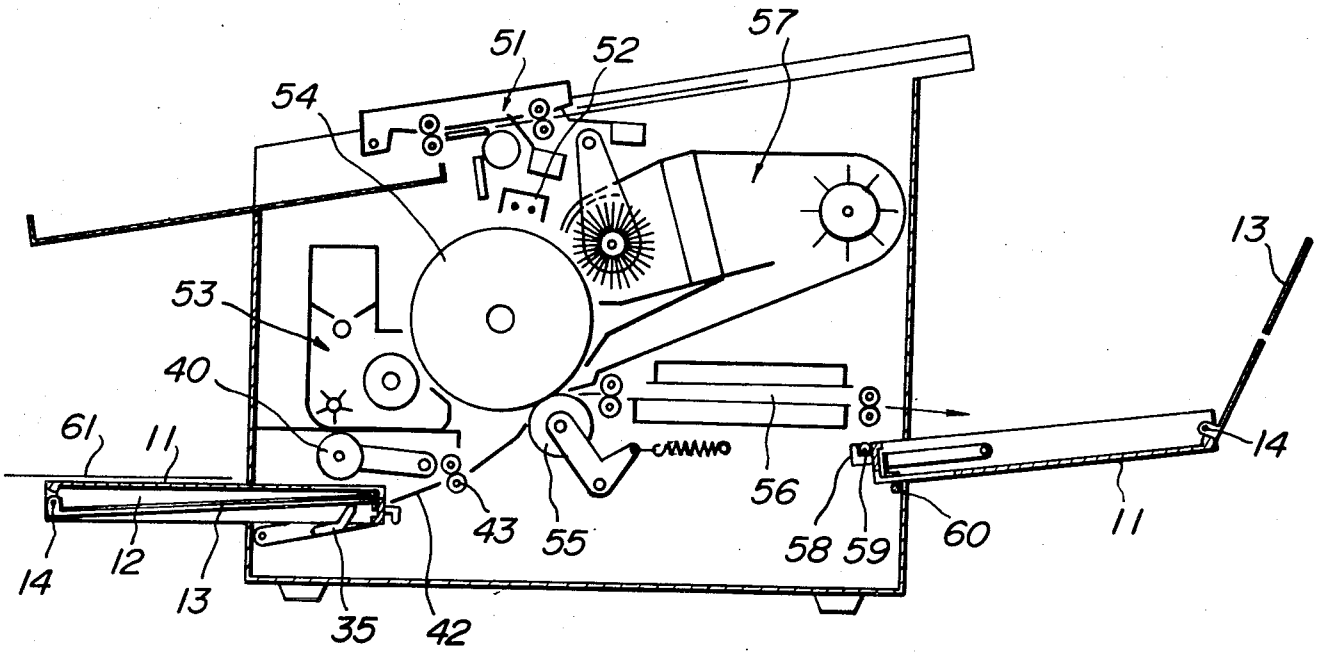
FIG. 19 is a diagrammatic cross-sectional view of a cassette according to the invention applied to an electrographic apparatus and used also as a sheet delivery tray.

FIG. 19 shows an electrographic apparatus which makes use of a sheet holding cassette shown in FIG. 2 as a sheet delivery tray. As described above, the uppermost sheet is picked up from a stack of sheets 12 in a cassette 11 by means of a pick up roller 40 and supplied through guide rollers 43 to a transfer roller 55. The electrographic apparatus is composed of a manuscript supplying part and light exposing part 51, corona discharge device 52, toner developing device 53, photosensitive drum 54, transfer roller 55 and fixing device 56 or the like. The record sheet enclosed in the cassette 11 is supplied to the transfer roller 55 where the toned image is transferred to the record sheet. The toned image is fixed by the fixing device 56 and then is discharged into the outside of the apparatus. Reference numeral 57 designates a cleaning device for cleaning the toner remained on the photosensitive drum 54. It is a matter of course that the record sheet discharged from the apparatus is received by a delivery tray. The cassette 11 constructed as above described according to the invention may also be used as such delivery tray. That is, to that end of the cassette 11 which is opposite to the pivot 14 is secured an angular fixture 58 adapted to be engaged with a pin 59 extending through the electrographic apparatus. The cassette 11 is engaged with another pin 60 extended through the electrographic apparatus as shown in FIG. 11. The cassette 11 is turned upside down so as to open the sheet receiving plate 13 upwardly. Under such condition, the cassette 11 serves as a delivery tray. Copied record sheets successively discharged into the delivery tray are superimposed one upon the other in such condition that the copied image surface is faced upwardly and the plain uncopied sheet surface is faced downwardly. Then, the cassette 11 is disengaged from the sheet delivery part of the electrographic apparatus and the sheet receiving plate 13 is closed. The cassette thus closed is mounted on the sheet supply part, and the plain uncopied sheet surface may be copied, thereby easily copying both upper and lower surfaces of the record sheet. It is a matter of course that use may be made of a conventional delivery tray where it is desired to copy one surface only of the record sheet.

In addition, the upper surface of the cassette 11 according to the invention is substantially flat. As a result, if it is desired to copy only one record sheet, the record sheet may be manually disposed on the upper surface of the cassette as shown by reference numeral 61 in FIG. 19 and then supplied to the transfer part 55. This measure is convenient in the case of copying two surfaces of one record sheet.

The invention is not limited to the above described embodiments. Provided that the sheet receiving plate 13, 107 is permitted to be opened and closed with respect to the cassette, various changes and alternations may be made to the construction of the separating claws 20, 20; 110A, 110B and locking mechanism for the sheet receiving plate 13, that is, construction of the stopper 17 or the like. In addition, it is not indispensable to use the cassette according to the invention as the delivery tray. The construction of the angular fixture 58 for securing the cassette to the photographic apparatus may also be changed. In addition, alternations may be made to means for automatically retreating the sheet receiving plate pushing up member 35 from the path of the cassette when the cassette is mounted on the sheet supplying device. The sheet holding cassette according to the invention may be applied not only to the electrographic apparatus but also to a printing machine or the like.

As stated hereinbefore, the sheet holding cassette according to the invention has a number of advantages. In the first place, the cassette is capable of widely opening its sheet receiving plate 13 and charging the stack of sheets from that side of the cassette which is opposed to the separating claws, so that in the case of charging the sheet into the cassette the separating claws do not obstruct the cassette. Secondly, the sheet receiving plate serves also as the base plate of rhe cassette, so that the cassette is simple in construction. Third, means for pushing up the sheet receiving plate automatically retreats from the path of the cassette when the cassette is inserted into and removed from the sheet supplying device, so that the cassette can detachably be mounted on the sheet supplying device in an easy manner. Fourth, provision is made of a resilient leaf spring for urging the stack of sheets against the separating claw when the lower open end of the cassette is closed by the sheet receiving plate, so that it is not necessary to charge the stack of sheets into the cassette against the action of the resilient force of the resilient leaf spring and that the operations of charging the stack of sheets into the cassette becomes easy. Fifth, if the resilient member for urging the stack of sheets against the separating claw is provided at the cassette side, the sheet supplying device becomes simple in construction. Sixth, if the leaf spring is mounted on the outer surface of the sheet receiving plate, the leaf spring may be used as a handle for opening and closing the sheet receiving plate. Finally, since the sheet receiving plate is opened and closed with respect to the cassette, so that it is possible to also use the cassette as a delivery tray and particularly both surfaces of a record sheet can easily be copied without requiring independent sheet supply paths for both copies.

What is claimed is:

1. An improved sheet holding cassette containing a number of superimposed sheets being detachably mounted on a main body of an electrographic apparatus, the improvement comprising: a box-shaped cassette main body (104) whose base surface is substantially fully open, a window (105) provided in the upper front portion of said cassette main body and through which a sheet feed roller (102) is urged against the uppermost sheet of the superimposed sheets, a sheet receiving plate (107) substantially closing the open base surface of the cassette main body, being rotatably pivoted at the lower rear portion of said cassette main body so as to be moved inwardly and outwardly with respect to the cassette main body, a leaf spring (111) integral with said sheet receiving plate being operative to urge said sheets against said sheet feed roller, a hook member (114), (120), (130), (142), (161) provided at the free end of the leaf spring and of the sheet receiving plate, operative to prevent the sheet receiving plate from rotating outwardly by the leaf spring when said sheets are inserted into the cassette, and separating claws (110A), (110B) arranged near said window, operative to separate the sheets one-by-one from the superimposed sheets, whereby said cassette main body is upside down and then the sheet receiving plate is made open outwardly, subsequently the superimposed sheets are inserted into the cassette main body and the sheet receiving plate is closed and locked to the cassette main body through the hook member, whereby the uppermost layer of the superimposed sheets is always kept at a given position when urged against the separating claws and the uppermost layer of the superimposed sheets is ready to be fed when the cassette main body is inserted into the electrographic apparatus.

2. The sheet holding cassette according to claim 1, wherein: said sheet receiving plate (107) contacts the lowest layer of the superimposed sheets and said hook member (114) is provided on said leaf spring.

3. The sheet holding cassette according to claim 1, wherein: said leaf spring (160) contacts the lowest layer of the superimposed sheets and said hook member (117) is provided on said sheet receiving plate.

4. The sheet holding cassette according to claim 1, wherein: said separating claws (110A), (110B) are secured to the cassette main body.

5. The sheet holding cassette according to claim 1, wherein: said separating claws (110A), (110B) are movable toward the uppermost layer of the superimposed sheets.

6. The sheet holding cassette according to claim 1, wherein: said cassette main body is provided at its front edge wall with an angular fixture (58) operative to use the cassette as a delivery tray.

* * * * *